United States Patent [19]

Harrison

[11] 4,409,287

[45] Oct. 11, 1983

[54] SKI PROTECTIVE DEVICE

[76] Inventor: Thomas B. Harrison, 534 Highland Blvd., Richardson, Tex. 75081

[21] Appl. No.: 271,833

[22] Filed: Jun. 9, 1981

[51] Int. Cl.[3] ..... A63C 5/00

[52] U.S. Cl. ..... 428/343; 428/40; 428/518; 428/520; 428/522; 428/523; 525/221; 525/919; 273/DIG. 22; 280/601; 280/610

[58] Field of Search ..... 428/40, 46, 343, 518, 428/520, 522, 523, 334, 339; 525/221, 919; 273/DIG. 22; 280/601, 610

[56] References Cited

U.S. PATENT DOCUMENTS

| | | | |
|---|---|---|---|
| Re. 30,726 | 9/1981 | Otten | 428/35 X |
| 3,264,272 | 8/1966 | Rees | 273/DIG. 22 |
| 3,567,237 | 3/1971 | Miller . | |
| 3,704,023 | 11/1972 | Downs . | |
| 3,816,234 | 6/1974 | Winfield | 428/327 X |
| 3,980,312 | 9/1976 | Buttner . | |
| 4,047,735 | 9/1977 | Ferch . | |
| 4,090,464 | 5/1978 | Bishopp et al. | 428/46 X |
| 4,140,330 | 2/1979 | Ferch . | |

OTHER PUBLICATIONS

Modern Plastics Encyl., "Ionomer Resius"; 9/1967, vol. 45; No. 1A, pp. 119–120.

*Primary Examiner*—Alexander S. Thomas
*Attorney, Agent, or Firm*—Richards, Harris & Medlock

[57] ABSTRACT

A transparent, flexible, scratch resistant covering (12) is adhesively affixed to the top surface of a snow ski (10). The covering protects the top surface of the ski against scratching during use. The covering is preferably a sheet of plasticized ionomer resin.

2 Claims, 2 Drawing Figures

SKI PROTECTIVE DEVICE

TECHNICAL FIELD

This invention pertains generally to snow ski equipment and more particularly to the application of protective materials to the surfaces of snow skis.

BACKGROUND ART

Transporting skis, crossing skis, and collisions in lift lines cause undue wear and tear on ski surfaces. While adequate means exist to repair ski bases, no effective way is generally available to restore ski tops. Scratched, chipped and damaged tops always reduce the resale value of used skis by a significant amount.

Although protective coverings have been used in the past for applying to the top surface of skis, these prior art coverings have not been able to withstand the wearing and abuse to which they are subjected during normal use of the skis. Thus, the coatings have become cut and dislodged from the ski surface leaving the skis unprotected. Further, some protective coatings have been incapable of adhering to the ski surface during the variable temperatures to which the skis are subjected during normal use.

SUMMARY OF THE INVENTION

The invention provides a protective covering for snow skis for improving their appearance and resale value. The invention also provides a protective covering for snow skis which can withstand the wear and abuse to which skis are normally subjected while being able to maintain their adherence to the skis even in view of the variable temperatures encountered by the snow skis in use.

This is accomplished in accordance with the present invention by applying a flexible covering of a predetermined rigidity to the top surfaces of the skis using a releasable contact adhesive. However, since the top surfaces of skis often are provided with fanciful colors and designs, the covering is preferably transparent. Therefore, in accordance with an important feature of the invention, transparent coverings are adhesively applied to the top surface of the skis to preserve their attractive appearance by protecting the top surfaces of the skis from scratching or scuffing. Such scratching or scuffing is a common occurrence because the bottom edges of skis are usually very sharp and crossing of skis and contact with other skiers in crowded lift lines is virtually unavoidable.

It will be appreciated that the thickness of the transparent covering must be compromised somewhat to obtain flexibility, lightweight, good abrasion and cut resistance. However, the present invention incorporates a material which exhibits good abrasion resistance while being transparent and resilient. This material is a thermoplastic sheet comprising as its principal component an ionomer resin. Ionomer resin is a copolymer of ethylene and a vinyl monomer with an acid group such as methacrylic. The ethylene and vinyl are cross-linked by ionic as well as covalent bonds. Because this material is very stable and durable, it may be used in relatively thin sheets, on the order of five (5) to fifteen (15) mils, to provide a transparent covering which gives adequate protection from scratching or scuffing, and which is resilient and suitable for cold weather service.

Additional advantages and novel features of the present invention may be best understood by reference to the following detailed description of an illustrative embodiment when read in conjunction with the accompanying drawings.

DETAILED DESCRIPTION

Figure 1:
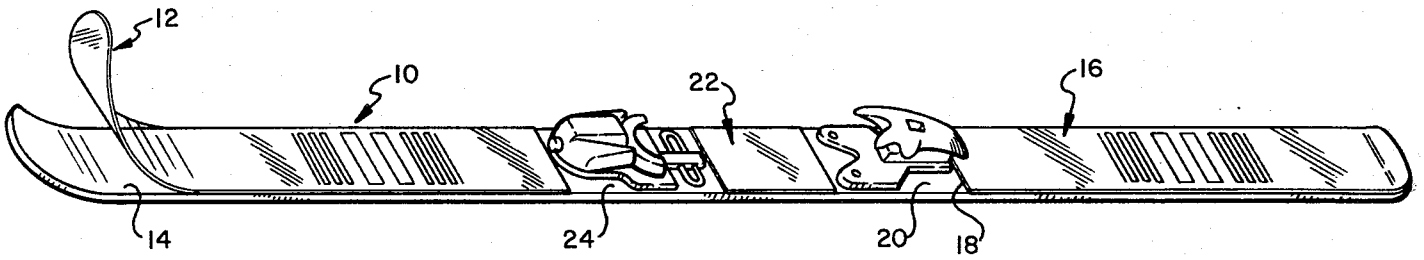
FIG. 1 is a perspective view illustrating plastic sheets installed and being installed on a ski in accordance with the present invention.

With particular reference to FIG. 1, a conventional snow ski is illustrated and designated by reference numeral 10. A covering 12 is illustrated in the process of being installed on the front top surface 14 of the ski 10. A second protective covering 16 having a forward edge 18 is illustrated after being installed on the rear top surface 20 of the ski 10. A third protective covering 22 is installed on the intermediate top surface 24 of the ski 10.

Figure 2:
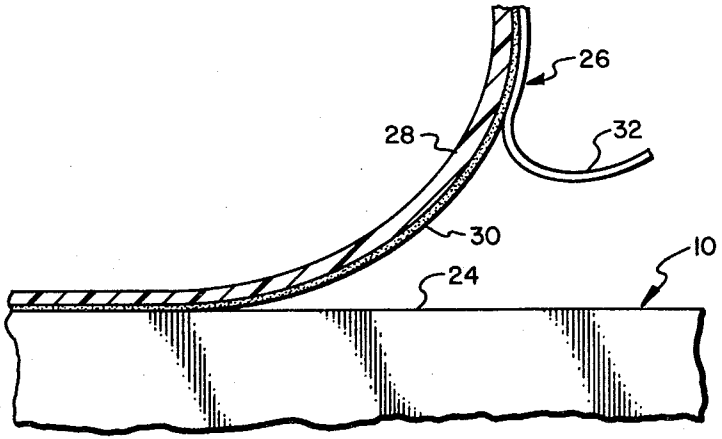
FIG. 2 is an enlarged side elevation view, partly in section, of a portion of a ski illustrating additional details of the installation of a plastic sheet on the ski.

The details of a preferred technique for installing the coverings 12, 16 and 22 are depicted by way of example in FIG. 2, wherein numeral 26 generally designates such a covering. The principal element of the covering is a thin sheet 28 of a transparent, flexible material having good hardness characteristics.

The sheet 28 is installed on the ski 10 by means of a layer of adhesive 30. The adhesive 30 is preferably of the pressure-sensitive type, such as a solvent based acrylic resin, which is transparent and does not turn yellow from age or exposure to sunlight and adheres to an item when pressed against it but will release from the item when pulled away, even after a prolonged period of adhesion. Other adhesives also can be used to good advantage. In the preferred embodiment, the layer of adhesive 22 is applied directly to a treated underside of sheet 28.

To protect the adhesive layer 30 prior to installation, a backing sheet 32 of waxed paper, silicone laminate or other suitable masking material is affixed to the adhesive layer 30 as shown at the upturned portion of the covering 26. The sheet 32 may be easily peeled away as depicted in FIG. 2 during the process of bonding the covering 26 to the top surface of the ski 10.

To accommodate skis having different widths and tip shapes, the covering 26 is made somewhat wider than the widest of the skis generally available in the marketplace, a preferred sheet width being approximately four inches. Once the backing sheet or release paper 32 is removed and the covering 26 is applied to the top surface of the ski 10, the marginal edges of the covering 26 are trimmed with a sharp blade to the exact shape of the ski 10.

In accordance with an important feature of the invention, the thickness and material characteristics of the sheet 28 are selected to provide optimum cosmetic protection without adding noticeable weight or stiffness to the ski.

A preferred material for the sheet 28 comprises a thermoplastic ionomer resin, such as the thermoplastic ionomer resin marketed under the name Surlyn, a trademark of DuPont Corporation. Plasticized ionomer resin is flexible, transparent, grease resistant, and very lightweight, but durable. The Izod impact strength is 5.7–14.6 foot pounds per inch and its tensile strength is 3,500–5,500 psi. Its elongation is 300%–400% and its softening point is 160° F. It is insoluble in any commercial solvent and is resistant to hydrocarbons and acid attack.

The hardness characteristics of the protective sheet 28 can be altered by combining a polymer such as polyethylene with the ionomer resin. For example, a polymer resin mixture of seventy-five percent (75%) by weight of ionomer resin and twenty-five percent (25%) weight of polyethylene resin produces a relatively softer sheet which is waterproof and which is well suited for cold weather service. Additionally, it is relatively flexible, but is not as abrasion resistant as a sheet of plasticized ionomer resin.

Regardless of ski length, it is preferred that the coverings 26 be applied to the entire exposed top surface of the ski. Sheets applied to snow skis in such a manner provide a simple, inexpensive technique for preventing scratches and cuts on the cosmetic surfaces of snow skis without adverse effects on the dynamics or appearance of the ski.

As previously mentioned, such plastic sheets have the additional advantage of protecting the top surface of the ski from scratching and scuffing. Thus, a minimum sheet thickness must be maintained to prevent the sheets from being cut and torn away after coming in contact with the sharp edges of other skis.

In accordance with an important feature of the invention, the adhesive layer 30 preferably comprises a transparent acrylic adhesive and the plastic sheet 28 is also transparent so that the colors and attractive designs of the top surface of the skis will be visible. In this respect, the plasticized ionomer resin provides the additional benefit of being relatively scratch resistant, so that the ski will remain attractive when protected by such sheets.

Thus, the present invention provides a protective covering for the upper surfaces of skis, the covering being sufficiently tough to prevent damage to the skis as well as the covering during normal use of the skis. In addition, while the covering is sufficiently tough to provide protection for a substantial period of time, it is sufficiently thin to permit the natural appearance of the skis to be viewed therethrough. It has been found that materials other than those disclosed herein, for example, vinyl, mylar or polyethylene alone, have not been capable of providing the features afforded by the present invention.

Although the foregoing preferred embodiments and examples of the invention have been described in detail, it is to be understood that various changes, substitutions and alterations can be made therein, without departing from the scope and spirit of the invention as defined by the appended claims.

I claim:

1. A protective covering for use on the upper surface of a snow ski comprising a sheet of a plasticized mixture of ionomer resin and polyethylene resin, and a layer of pressure-sensitive adhesive resin bonded to one side of said plasticized sheet.

2. The protective ski covering as defined in claim 1 wherein said ionomer resin comprises 75% by weight, and said polyethylene resin comprises 25% by weight.

* * * * *